33-241 SR
12/9/86 OR 4,627,171

United States Patent [19]
Dudney

[11] Patent Number: 4,627,171
[45] Date of Patent: Dec. 9, 1986

[54] RETICLE ILLUMINATOR

[76] Inventor: Morris S. Dudney, 2001 E. Fifth St., Austin, Tex. 78702

[21] Appl. No.: 493,033

[22] Filed: May 9, 1983

[51] Int. Cl.[4] ..... F41G 1/32
[52] U.S. Cl. ..... 33/241
[58] Field of Search ..... 33/241; 362/110; 350/235, 236, 523, 537, 528

[56] References Cited

U.S. PATENT DOCUMENTS

| | | | |
|---|---|---|---|
| 802,277 | 10/1905 | Fric | 33/241 |
| 1,084,905 | 1/1914 | Schwarz | 33/241 |
| 1,728,993 | 9/1929 | Gerdes | 350/537 |
| 1,931,552 | 10/1933 | Maris | 33/241 |
| • 2,472,809 | 6/1949 | Decker | 33/241 X |

*Primary Examiner*—Harry N. Haroian
*Attorney, Agent, or Firm*—Bernard Reiter

[57] ABSTRACT

A portable, battery powered, cross-hair illuminator for rifle scopes and similar instruments. In this embodiment, the Reticle Illuminator is a bolt-on attachment to rifle scopes or similar sighting devices using cross-hairs or other aim point configurations. The Reticle Illuminator is attached to the occular end of a rifle scope by means of an expandable clamp band. The evice itself consists of a main housing to which the clamp band screw is attached. Within the main housing is the electrical circuitry, including battery sleeve, battery switch, and lamp. When activated by switch, the system emit a beam of light into an optical fiber, surrounded by a transmitting tube, making possible the precise projection of light through a conventional lense system to strike and illuminate an unaltered reticle.

12 Claims, 3 Drawing Figures

RETICLE ILLUMINATOR

FIELD OF THE INVENTION

The present invention relates to the field of those devices which contrast an illuminated aim point projected onto the focus plane. against the position of an observed object, and more particularly to a cross-hair illuminator adaptable to any standard rifle scope equipment.

DESCRIPTION OF THE PRIOR ART

Previous attempts assume that the solution to the problem of too little contrast between scope cross-hairs and targeted objects must take the form of replacing or supplanting the existing cross-hairs with lighted aim points.

Other previously attempted solutions dealing primarily with night vision equipment, call for the illumination of the reticle by methods not easily adaptable and very often impossible to use with existing optical equipment.

One such illuminated reticle is provided by an edge-lit moveable plastic plate positioned over the photocathode of an image plane of an objective lens. Other types of illuminated reticles are very often mounted within cored-out objective lens assemblies which may or may not be adjustable in azimuth or elevation. Another type of illuminated reticle for night vision is described and illustrated in U.S. Pat. No. 3,552,819. In all of these illuminated reticles, manufacturing costs are considerable. For example, to provide such reticles, mechanical assemblies very often must be placed within the objective lens assemblies and appropriately sealed. In certain types of illuminated reticles, the glass objective lens elements must be bored. In most such illuminated reticles the objective lens assembly must be disassembled and reassembled. This requires skilled work at a factory site which also prevent field installation or service of the illuminated reticles. Still further, many such illuminated reticles are not of the type which can be adjusted in either azimuth or elevation or both.

SUMMARY OF INVENTION

It is therefore the object of the invention to provide a supplemental device to enable a user of standard existing scope equipment to perform sighting with an illuminated reticle.

Another object of the invention is to provide a device which is compatible with standard or wide-field telescopic sights.

A further object of the invention is to provide a device which is compatible with variable or fixed powder scopes.

Another object of the invention is to provide a device which works with all types of aim points including, but not limited to, fixed cross-hairs, graduated cross-hairs, posts, and dots.

A still further object of the invention is to provide a device which is easily attachable and detachable without tools such that is offers availability for alternating use among a multiplicity of scopes of varying dimensions.

Another objective of the invention is to provide a lightweight option for reduced light level sighting.

A further object of the invention is to provide a supplemental device for standard scope equipment which is usable without requiring permanent alteration of the scope. Overcoming the limitations of previous designs, the present invention is designed to eliminate all these troublesome restrictions by offering an efficient, durable and practicable device for aim point illumination. The invention is provided with the means to illuminate existing cross-hairs on standard rifle scopes by a new and simpler mode of operation; i.e. introduction of a light source from outside the lens system. This function is further enchanced by the present invention's compatibility with all standard scope equipment. The present invention is a supplemental device for all existing standard rifle scopes and serves to yield increased efficiency and flexibility for the users of those scopes by making possible the sighting of a targeted object in reduced light levels; i.e. a conventional scope previously confined to daylight operation can be made functional twenty-four hours per day. In addition, the present invention produces dramatically reduced operating costs for those people engaged in low light sighting. By enabling the user to use standard telescopic sights, he avoids the need for more sophisticated, expensive equipment such as ultrasensitive light gathering systems, heat sensing systems, and scopes that are specially refabricated to contain lighted aim points.

DESCRIPTION OF THE PREFERRED EMBODIMENT

Figure 3:
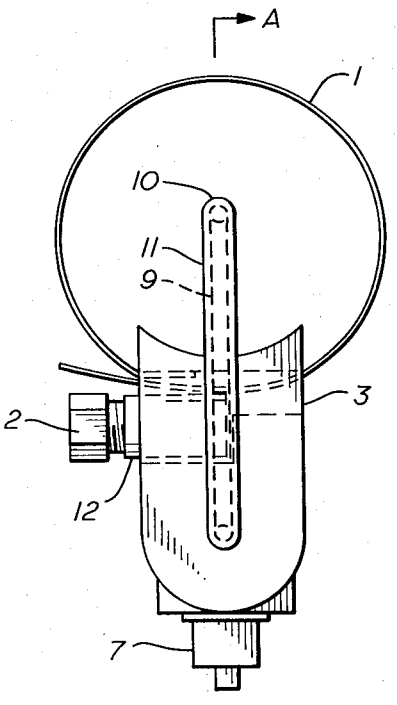
FIG. 3 is a view of the device from the front with the light fiber directing light away from the viewer's eye.

Referring to the drawing, the present invention is attached to the end of the scope nearest to the eye of the user by means of an expandable clamp band 1. The clamp band 1 goes around the rifle scope and is tightened by means of a calmp screw 2 which threads into a clamp screw receptacle 12. The device itself consists of a main housing 3 to which the clamp screw receptacle 12 is inserted. Connected to the main housing is a battery sleeve 4 which holds a power source, in this case a AA size battery 5 held in by a plug 8, and also a light source, in this case a small light bulb 6 that is turned on and off manually by a switching mechanism 7 attached to such battery sleeve.

Figure 2:
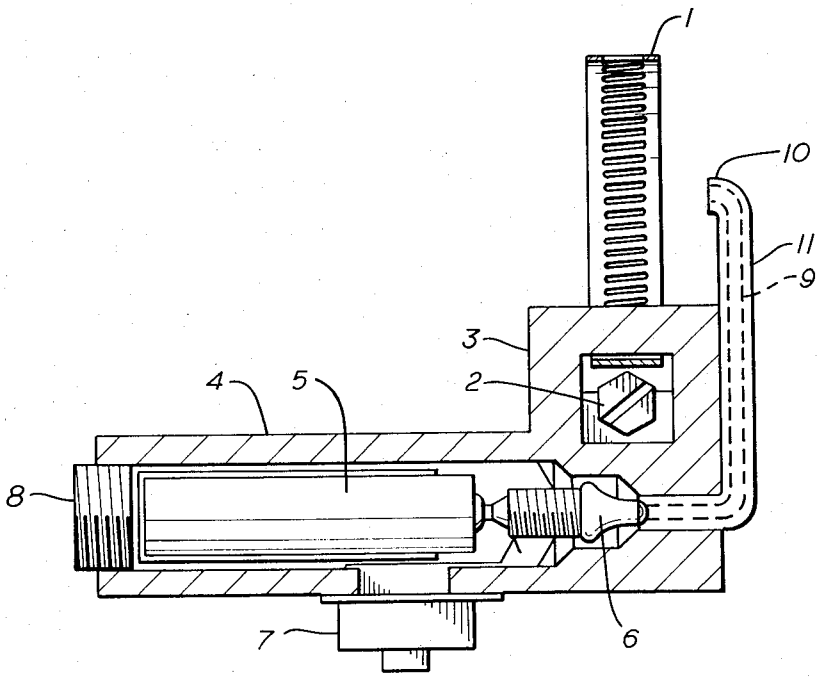
FIG. 2 is a cross sectional view of the device.
Figure 1:
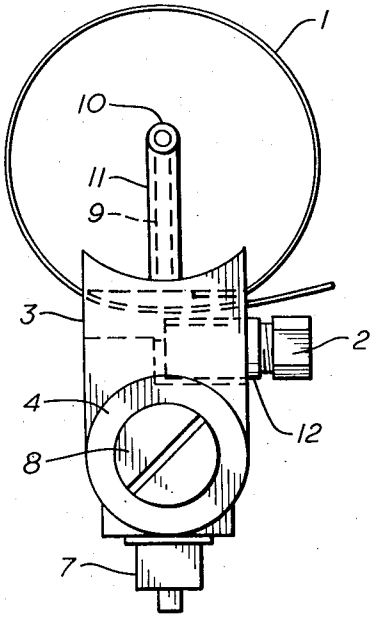
FIG. 1 is a view of the device from the rear with the light fiber directing light toward the viewer's eye.

In operation, when the switch 7 is turned on, the light from the bulb 6 shines into an optical fiber 9 encased in a transmitting tube 11 causing light to travel along the path noted in FIG. 2 by the arrows, and be cast out of the projection end 10 of the optical fiber. The light beam leaving the projection end 10 in turn travels down the interior of the scope until it strikes the cross-hairs of the scope and illuminates same.

Having thus described the invention, it is to be understood that certain modifications in the construction and arrangement of the parts thereof will be made, as deemed necessary, without departing from the scope of the appended claims.

We claim:

1. An attachment device for illuminating the reticle of a telescopic device through the eyepiece lens thereof, comprising: a housing; a light source enclosed in said housing and power source means also in said housing for actuating said light source; optical fiber means mounted to said housing, said optical fiber means having a first input end proximate said light source and a second output end located proximate the external side of said eyepiece lens for providing an illuminating light path from said light source to said reticle through said eyepiece lens; and means for removably positioning said housing on said telescopic device adjacent said eyepiece lens so that said second output end of said fiber optics means is adjacent said eyepiece lens.

2. A device as recited in claim 1, wherein said means for positioning said housing clampingly engages the exterior of the optical equipment and is attachable to, detachable from and reusable thereon.

3. A device as recited in claim 2, wherein said means for positioning said housing is an adjustable band clamp.

4. A device as recited in claim 1, wherein said optical fiber means is encased in a rigid transmitting tube allowing said optical fiber to be formed in a permanent fixed configuration.

5. A device as recited in claim 4, wherein said optical fiber means and said transmitting tube are formed in a curved configuration so that said first end and said second end of said optical fiber means are directed approximately parallel to each other.

6. A device as recited in claim 1, wherein said housing is adjoined to a battery sleeve which is hollow and cylindrical in nature and open at a cantilevered end so that said light source and said power source means can be inserted therein with said light source passing through said battery sleeve and into said housing.

7. A device as recited in claim 6, wherein there is a small aperture extending through the housing located colinearly with the cylindrical axis of said battery sleeve so that said first end of said optical fiber can be inserted therein to abut said light source with a second end of said optical fiber means being free and extending beyond said housing.

8. A device as recited in claim 6, wherein a removable plug can be inserted into said cantilevered end of said battery sleeve so that said power source means and said light source can be held firmly in place.

9. A device as recited in claim 1, further comprising an on/off switch so that said light source can be activated and deactivated.

10. An attachment apparatus for illuminating the sight on an optical apparatus equipment, comprising:

(a) a housing;

(b) means for receiving a light source which is enclosed in said housing and which can be actuated by a power source;

(c) a transmitting tube containing a light transmitting material which acts as a light path so that the sight in the optical apparatus may be illuminated, said light transmitting material being characterized by a curved configuration having two ends with a first end of said light transmitting material being proximately located to said light source receiving means and a second end of said light transmitting material being proximately located to the eye lens of the optical equipment, the emitted light from said second end of said optical fiber directed through the eye lens of the optical equipment; and (d) a means for intending releasably positioning said housing on pieces of optical equipment of differing dimensions, one at a time, so that they may be used with or without the attachment thereon.

11. A device for illuminating the reticle of optical equipment, comprising:

(a) a housing;

(b) a light source which is enclosed in said housing and which can be actuated by a power source;

(c) an optical fiber which acts as a light path so that light may be directed onto a reticle in an existing piece of optical equipment and wherein said optical fiber has a first end proximately located to said light source;

(d) means for removably positioning said housing on a piece of optical equipment for facilitating use or not of said device with respect to the equipment;

(e) a battery sleeve which is hollow and cylindrical in nature and opened at a cantilevered end so that said light source and said power source can be inserted therein with said light source passing through said battery sleeve and into said housing, said housing extending perpendicularly from said battery sleeve with a cantilevered end having a cylindrically concave face so that the axis of said cylindrical concavity is parallel to the cylindrical axis of said battery sleeve and said cylindrical concavity will fit neatly against the curved exterior of a piece of optical equipment;

(f) a small aperture extending through said housing located colinearly with the cylindrical axis of said battery sleeve so that said first end of said optical fiber can be inserted therein to abut said light source with a second end of said optical fiber being free and extending beyond said housing;

(g) a transmitting tube encasing said optical fiber formed in a curved configuration so that said first end and said second end of said optical fiber are directed approximately parallel to each other.

12. A device as recited in claim 11 wherein: said housing has a larger aperture extending through it just below said cylindrically concave face and perpendicular to the cylindrical axis of said battery sleeve allowing a clamp screw and a clamp screw receptacle of an adjustable band clamp to be inserted therein and a clamp band of said adjustable band clamp to be passed therethrough so that said clamp band forms a continuous circle which can be placed around a piece of optical equipment.

* * * * *